United States Patent [19]

Schumann et al.

[11] Patent Number: 4,797,231

[45] Date of Patent: Jan. 10, 1989

[54] MULTIPURPOSE CLEANING PREPARATIONS FOR HARD SURFACES

[75] Inventors: Klaus Schumann, Erkrath; Ortburg Guirr, Krefeld; Paul Schulz, Wuppertal; Franz Foerg, Langenfeld, all of Fed. Rep. of Germany

[73] Assignee: Henkel Kommanditgesellschaft auf Aktien, Duesseldorf, Fed. Rep. of Germany

[21] Appl. No.: 150,464

[22] Filed: Feb. 5, 1988

Related U.S. Application Data

[63] Continuation of Ser. No. 851,636, Apr. 14, 1986, abandoned.

[30] Foreign Application Priority Data

Apr. 18, 1985 [DE] Fed. Rep. of Germany ..... 3514019
Jan. 22, 1986 [DE] Fed. Rep. of Germany ..... 3601798

[51] Int. Cl.[4] ..... C11D 1/18; C11D 1/12

[52] U.S. Cl. ..... 252/547; 252/552; 252/553; 252/162; 252/163; 252/165; 252/166; 252/171; 252/174.25; 252/DIG. 14

[58] Field of Search ..... 252/174.25, DIG. 14, 252/545, 546, 547, 8, 550, 554, 553, 162, 163, 165, 166, 171, 549, 552

[56] References Cited

U.S. PATENT DOCUMENTS 4,396,525 8/1983 Rubin et al. ..... 252/174.25

FOREIGN PATENT DOCUMENTS 1140831 3/1983 Canada .
1143240 3/1983 Canada ..... 134/32
1160134 1/1984 Canada ..... 134/32
1181607 2/1970 United Kingdom .

OTHER PUBLICATIONS

Chemical Abstracts, vol. 105, Nov. 1986, p. 131, under 174864m.

*Primary Examiner*—Josephine Barr
*Attorney, Agent, or Firm*—Ernest G. Szoke; Henry E. Millson, Jr.; Real J. Grandmaison

[57] ABSTRACT

Substantially, builder-free, liquid, suspension-stable multipurpose cleaning preparations containing abrasives, a surfactant base of mixtures of anionic surfactants or anionic surfactants and amphoteric surfactants, and water, and having a pH-value of from 5.5 to 9.5. These preparations can be used for cleaning hard surfaces of all kinds and in particular can be used as dishwashing detergents, multipurpose cleaners, scouring preparations and/or polishes.

15 Claims, No Drawings

MULTIPURPOSE CLEANING PREPARATIONS FOR HARD SURFACES

This application is a continuation of application Ser. No. 851,636 filed 4/14/86 abandoned.

BACKGROUND OF THE INVENTION

1. Field of the Invention

This invention relates to aqueous, liquid, builderless, suspension-stable multipurpose cleaning preparations for hard surfaces which act as abrasives or polishes when applied in dilute form to hard surfaces, but which behave like typical water-soluble, manual dishwashing detergents or like non-abrasive multipurpose cleaners for hard surfaces, depending on the degree of dilution with tapwater.

2. Description of Related Art

Liquid, manual dishwashing detergents which are generally used at slightly elevated temperatures essentially contain as their active components mixtures of synthetic anionic surfactants in quantities of from about 4 to 60% by weight and, optionally, small quantities of nonionic surfactants, preferably alkanolamides, or amphoteric surfactants, and also solvents, solution promoters, hydrotropes, perfumes and dyes, preservatives, viscosity regulators, pH regulators and electrolytes. In order to protect the skin, the pH value is in the range of from about 5.5 to 8.0. In some cases, although not typically, they may contain small quantities of builders or complexing agents, such as hexametaphosphate or ethylene diamine tetraacetate, for use in areas with water of high iron content. Preparations such as these are known, for example from European Pat. No. 36,625.

Multipurpose cleaning preparations, i.e. preparations for cleaning various hard surfaces both in the home and in industry and commerce, preferably contain as their active components combinations of anionic and nonionic surfactants in a total quantity of from about 5 to 15% by weight together with detergency-enhancing builders in quantities of from about 0.5 to 5% by weight. The other detergency-enhancing components used are generally solvents, including terpene compounds, while polyethylene glycols corresponding to the general formula $HO—(CH_2—CH_2—O)_n—H$, where n may vary from 4,800 to 64,600, are used as organic polymers to increase cleaning performance. These preparations also contain dyes and perfumes, electrolytes and viscosity regulators. Their pH-value is preferably in the range of from 8.5 to 11 because the cleaning power which, in the case of these preparations, has to be developed mainly at room temperature is generally better in an alkaline medium than in a neutral or acidic medium. Multipurpose cleaning preparations of this type are also known, for example, from German Pat. No. 27 09 690 and from corresponding European Pat. No. 9,193. No provision is made in such preparations for the inclusion of abrasives.

Mild scouring preparations can also be used for cleaning movable and immovable hard surfaces, such as walls, tiles, cookers, sinks and the like. These mild abrasive preparations may be solid, liquid or paste-like. They contain relatively small quantities of surfactants, but relatively high concentrations of mildly alkaline inorganic builders. The scouring preparations naturally contain a large quantity of water-insoluble abrasives, for example feldspar, silica or pumice.

Accordingly, cleaning preparations of different composition are generally marketed and used for related, but different cleaning problems. In the household, however, manual dishwashing detergents are also frequently used for cleaning hard surfaces, particularly in the kitchen, although the cleaning results cannot be optimal in that case, as explained above. In this connection, it does not matter whether the dishwashing detergents are used in concentrated form or in dilute form. Conversely, the use of commercial multipurpose cleaners or liquid scouring preparations for manual dishwashing also gives unsatisfactory results.

Accordingly, there was a need for a multipurpose cleaner in which high detergency and compatability with the skin are combined with the high emulsifying power of conventional multipurpose cleaners and with the abrasive effect of a muld scouring preparation, i.e. which at a neutral pH-value shows a level of detergency which otherwise would only be obtained with alkaline, builder-containing cleaners.

Builderless liquid cleaning preparations which may be used on the one hand for scouring and on the other hand for manual dishwashing, i.e. as dual-purpose cleaning preparations, and which contain from 20 to 35% by weight of anionic surfactants, from 2 to 15% by weight of foam-stabilizing nonionic surfactants, from 1 to 20% by weight of water-insoluable abrasives having a particle diameter of from 15 to 150 μm and a Mohs' hardness of from 2 to 7 and also from 20 to 75% by weight of water are already known from European Patent Application No. 21,545. Correspondingly, useable abrasive-containing cleaners which may contain two different anionic surfactants, preferably in conjunction with nonionic surfactants, but in addition a required percentage of builders are described in Canadian Pat. No. 1,143,240. However, these known cleaners foam excessively for use as multipurpose cleaners (generally far away from any source of water) and, because of this, have to be wiped unnecessarily vigorously with moist sponge cloths in order to prevent the particles of abrasive from forming residues.

DESCRIPTION OF THE INVENTION

Accordingly, an object of the present invention is to provide a new, single cleaner composition which can be specifically used for scouring and for manual dishwashing, and also as a multipurpose cleaner and, optionally, as a polish.

Other than in the operating examples, or where otherwise indicated, all numbers expressing quantities of ingredients or reaction conditions used herein are to be understood as modified in all instances by the term "about."

The present invention relates to substantially builderless, liquid, suspension-stable multipurpose cleaning preparations for hard surfaces which contain abrasives, water, and a surfactant base of mixtures of anionic surfactants or anionic surfactants and amphoteric surfactants, and which have a pH-value of from 5.5 to 9.5. The invention also relates to their use as dishwashing detergents, multipurpose cleaners, scouring preparations, and/or polishes.

The preferred cleaning preparations of the invention have the following composition in which the percentages by weight are based on the weight of the total composition, unless otherwise indicated:

A. from 10 to 35 weight percent, preferably from 15 to 25 weight percent of a mixture of at least two of the following types of surfactants;

(a) at least one anionic sulfonate surfactant, (b) at least one anionic sulfate surfactant, and (c) at least one amphoteric surfactant.

When the mixture consists of a mixture of (a) and (b), from 5 to 95% by weight, preferably from 25 to 75% by weight of (a) and correspondingly from 95 to 5% by weight, preferably from 75 to 25% by weight of (b), based on the weight of the mixture, is present. Where the mixture includes (c), i.e. a mixture of (a) and (c), (b) and (c), or (a), (b), and (c), comprises from 0.5 to 15 weight percent, preferably from 0.5 to 5 weight percent, and more preferably from 1 to 2 weight percent of the cleaning preparation composition, i.e. if (c) is present in a quantity of 2 weight percent than the remaining surfactant or surfactants make up from 8 to 33 weight percent, preferably from 13 to 23 weight percent of the cleaning preparation composition. However, when amphoteric surfactants are present, the ratio by weight of anionic surfactants (component (a) or (b), or (a) plus (b)) to amphoteric surfactants (component (c)) is from 20:1 to 1:1, preferably from 15:1 to 1:1, and more preferably from 8:1 to 1:1.

B. from 5 to 20 weight percent, preferably 10 to 15 weight percent of at least one abrasive having a particle diameter of from about 5 to about 100 μm.

C. from 0 to 10 weight percent, preferably 2 to 6 weight percent of at least one viscosity regulator, provided that viscosity regulator must be present in quantity sufficient to obtain a viscosity for the preparations of the invention of from 2,000 to 12,000, preferably from 4,000 to 6,000 mPas sec ($D=5s^{-1}$) in order to maintain high suspension stability.

D. from 0 to 4 weight percent, preferably 0.3 to 1 weight percent of a fat solvent.

E. a pH regulator as needed to provide a pH in the range of from 5.5 to 9.5, preferably in the range of from 6.0 to 7.5.

F. remainder water.

In addition to the above components, small quantities of dyes, perfumes, preservatives, and antimicrobial agents can also optionally be present in the cleaning compositions of the invention.

The anionic surfactants employed in the cleaning compositions of the invention in Component A are preferably synthetic surfactants, of which at least two different types—particularly those of the sulfonate and sulfate type—are used together, as is normally the case with manual dishwashing detergents.

The sulfonate-type surfactants are alkylbenzene sulfonates containing $C_9$–$C_{15}$ and preferably $C_{12}$–$C_{15}$ alkyl groups, or, preferably, alkane sulfonates of the type obtainable from $C_{12}$–$C_{18}$ and preferably $C_{14}$–$C_{16}$ alkanes by sulfochlorination or sulfoxidation and subsequent hydrolysis or neutralization or by addition of bisulfites onto olefins, or $C_8$–$C_{18}$ and preferably $C_{12}$–$C_{18}$ olefin sulfonates, i.e. mixtures of the corresponding alkene and hydroxyalkane sulfonates, as well as disulfonates of the type obtained for example from monoolefins containing a terminal or internal double bond by solfonation with gaseous sulfur trioxide and subsequent alkaline and acidic hydrolysis of the solfonation products. Other suitable sulfonate-type surfactants are the esters of α-sulfofatty acids, for example α-sulfonated methyl or ethyl esters of hydrogenated coconut oil, palm kernel oil or tallow fatty acids.

Particularly suitable surfactants of the sulfate type are the sulfuric acid monoesters of primary alcohols of natural and synthetic origin, i.e. of fatty alcohols, such as for example coconut oil fatty alcohols, tallow fatty alcohols, oleyl alcohol or the $C_1$–$C_{20}$ oxoalcohols, and those of secondary alcohols having the same chain lengths. Othere suitable sulfatetype surfactants are the sulfuric acid monoesters of aliphatic primary alcohols ethoxylated with from 1 to 6 moles of ethylene oxide or of ethoxylated secondary alcohols or alkylphenols. Sulfated fatty acid alkanolamides and sulfated fatty acid monoglycerides are also suitable.

All of the above anionic surfactants are preferably used in the form of their salts, particularly their sodium salts, although they may also be used in the form of their potassium or ammonium salts or in the form of soluble salts of organic bases, such as mono-, di- or triethanolamine.

Suitable amphoteric surfactants which are optionally used as a portion of Component A. are those which contain both acidic groups, such as for example carboxyl, sulfonic acid, sulfuric acid semiester, phosphonic acid, or phosphonic acid partial ester groups, and also basic groups, such as for example primary, secondary, tertiary and quaternary ammonium groups, in the molecule. Amphoteric compounds containing quaternary ammonium groups belong to the betaine or zwitterionic surfactant type. Such compounds include, in particular, derivatives of aliphatic quaternary ammonium compounds in which one of the aliphatic groups consists of a $C_8$–$C_{18}$ group while the other contains an anionic water-solubilizing carboxy, sulfo or sulfate group. Typical representatives of surface-active betaines such as these are, for example, the compounds 3-(N-hexadecyl-N,N-dimethylammonio)-propane sulfonate, 3-(N-tallow alkyl-N,N-dimethylammonio)-2-hydroxypropane sulfonate, 3-(N-hexadecyl-N,N-bis-(2-hydroxyethyl)-ammonio)-2-hydroxypropyl sulfate, 3-(N-cocosalkyl-N,N-bis-(2,3-dihyroxypropyl)ammonio)-propane sulfonate, N-tetradecyl-N,N-dimethylammonio acetate, N-hexadecyl-N,N-bis-(2,3-dihydroxypropyl)-ammonio acetate. $C_{12}$–$C_{18}$-acylamidopropyl dimethyl ammonium betaines are preferably used herein.

Suitable abrasives for use as Component B are, in principle, any water-insoluble substances which have an average particle diameter of from 5 to 100 μm, preferably from 5 to 50 μm and more preferably from 5 to 15 μm. To vary the abrasive effect, it is particularly preferred to use combinations of abrasive silicas for the toothpaste industry, as described for example in Degussa's "Technical Information" on Sident TM 12, Sident TM 12 DS and polishing aluminas, as described in Giulini-Chemie's pamphlet entitled "Aluminumoxid/-Poliertonerde (Aluminum Oxide/Polishing Alumina)." Suitable polishing aluminas are described, for example, in Giulini-Chemie's pamphlet under the type names P 205, CTS FG, P 10 feinst, PS feinst, P 999 feinst and P 200 feinst. Using these very fine abrasives, which do not have a scouring effect and, accordingly, may also be referred to as "polishes," it is possible to prepare particularly mild scouring preparations which, in undilute form, can even be used with advantage for polishing sensitive metal surfaces.

Suitable viscosity regulators (Component C.) are water-soluble neutral salts, such as for example $NH_4Cl$ or NaCl, thickening silicas, for example Sipernat 22S TM, a Degussa product, polyethylene glycols having a molecular weight of from 200 to $4\times10^6$, organic polymers, such as polyacrylates, xanthan gum, cellulose and starch derivatives, and also inorganic layer silicates, for example bentonite. It is also possible for this purpose to incorporate solvents and solution promotors known per se, such as water-soluble organic solvents, particularly low molecular weight aliphatic alcohols containing from 1 to 4 carbon atoms, such as methanol, ethanol, isopropanol, ethylene glycol, propylene glycol and glycerol, and as solution promoters those having boiling points above 75° C., such as for example the ethers of identical or different polyhydric alcohols or the partial ethers of polyhydric alcohols. Solution promoters such as these include, for example, di- or triethylene glycol polyglycerols and also the partial ethers of ethylene glycol, propylene glycol, butylene glycol or glycerol with aliphatic monohydric alcohols containing from 1 to 4 carbon atoms in the molecule. Suitable water-soluble or water-emulsifiable organic solution promoters are also ketones, such as acetone, methylethyl ketone and aliphatic, cycloaliphatic, aromatic and chlorinated hydrocarbons.

However, so-called hydrotropes of the low molecular weight alkylaryl sulfonate type, including for example, toluene, xylene or cumene sulfonate, are also suitable as viscosity regulators and hence as solution promoters. They may be present in the form of their sodium and/or potassium and/or alkylamino salts. The viscosity of the preparations produced in accordance with the invention is adjusted in the laboratory and the corresponding ingredients and the quantities are then scaled up for the actual production process.

It is of particular advantage to add so-called fat solvents (Component D.), i.e. commercial terpene compounds preferably having a citrus fruit-like perfume characteristic, such as for example limonene as a terpene hydrocarbon or pine oil as a terpene alcohol, and/or glycol ethers having a high molecular weight of greater than 200,000 to $4\times10^6$, which not only have a viscosity regulating effect of their own on the liquid, abrasive-containing cleaning preparations themselves, but also to assist fat emulsification and soil detachment in use. In combination with the other constituents of the formulation, this provides for the improved removal of persistent, hydrophobic types of soil where the preparations according to the invention are used in concentrated form.

The polyethylene glycols (glycol ethers) that can be used in Component D. have the general formula $HO—(CH_2—CH_2—O)_nH$, where n may vary from 4,800 to 64,600. Polymers such as these are also commerically available and are marketed, for example, by Union Carbide Corporation (UCC) under the name of "POLYOX®."

With respect to Component E., suitable acidic agents for regulating the pH-value are the usual inorganic or organic acids or acid salts, such as, for example hydrochloric acid, sulfuric acid, bisulfates of the alkali metals, aminosulfonic acid, phosphoric acid or other acids of phosphorus, more especially the anhydrous acids of phosphorus or salts thereof or acidreacting solid compounds thereof with urea or other lower caroxylic acid amides, partial amides of phosphorus acids or anhydrous phosphoric acid, citric acid, tartaric acid, lactic acid and the like. Organic or inorganic compounds, such as alkanolamines, i.e. mono-, di- or triethanolamine, or ammonia can be added as basic substances. Alkaline-reacting compounds sometimes used in larger quantities as builders, and washing alkalis, such as for example sodium tripolyphosphate, sodium carbonate and sodium bicarbonate, potassium carbonate and bicarbonate, sodium silicate and the sodium alumosilicates, are suitable for use in small quantities for adjusting the pH, e.g. to a mildly alkaline pH-value.

Production of the cleaning preparations of the invention can be carried out by premixing the solid and liquid constituents and then homogenizing the resulting premix in a high-speed disperser. The main problem lies in removal of the considerable quantities of air in the preparation, some of which is introduced with the powder-form components, some entering the product in the premixing unit. Although the amount of air "stirred in" can be minimized by suitable design of the premixing unit, the total air content still amounts to about 20% by volume. In practice, products of high air content undergo considerable variations in density and, without exception, can not be stored. Because of this, the following procedure was adopted in accordance with the processes described in "Seifen, Oele, Fette, Wachse" 101 (1975), pages 125 to 128 and in DE-OS No. 26 19 810.

First, the surfactants and the water are introduced into a stirring vessel of abrasion-resistant material, preferably fine steel, provided with a stirrer comprising an anchor, to which wall strippers of abrasion-resistant low-friction material, preferably polytetrafluoroethylene, are attached, and a stirrer blade fixed to a second shaft which is offset at 90° relative to the anchor and which is moved at a peripheral speed of from 0.5 to 4, preferably from 1 to 1.5 m/sec.; after which all the other constituents, such as abrasives, stabilizers, dyes, viscosity regulators, suspension stabilizers, solvents, solution promoters and hydrotropes, are added to the solution with stirring. In this way, powder agglomerations, solid clumps and wall coatings are homogenized without the air content of the premix enamating from the raw materials being additionally increased by the induction of air. The mixture is then pumped through a flow-type disperser, preferably in the form of a rotor-stator machine, of which the shear gap and/or speed setting is adjusted to the average diameter of the abrasive particles so as to minimize disintegration of the abrasive during dispersion. After dispersion, the preparation obtained is deaerated using a flow-type vacuum degassing unit with centrifugal product distribution via rotating discs and a perforated plate. The pressure is adjusted to between 20 and 100 mm mercury column. This deaeration step may also be carried out before dispersion. Relatively volatile perfumes are added after deaeration. The throughput rate, the intensity of dispersion and the degassing vacuum are coordinated with one another in such a way that ultimately the products have a temperature of about 25° C., and can be directly packed.

Production may be carried out either continuously or in batches.

The liquid cleaning compositions of the invention canb e used as such, or diluted with water e.g. to as dilute as 0.25 grams of cleaning composition per liter of solution, preferably in the range of 0.4 to 1.0 g/l.

The following examples are given for illustration purposes only and not for purposes of limitation.

EXAMPLES

Plate Test

The cleaning effect of the preparations used in accordance with the invention in manual dishwashing was determined by the so-called plate test which is described in the journal "Fette, Seifen, Anstrichmittel," 74 (1972), pages 163 to 165. Plates 14 cm in diameter were alternately soiled with 2 g of beef tallow (melting point 40° to 42° C., acid number 9 to 10) and with 2 g of a mixture of egg white, fat and carbohydrates, stored for 15 hours at +0° to +5° C. and then rinsed with tapwater (hardness 16° d=German hardness) at 45° C. The products to be tested were used in a concentration of 0.5 g/l water. The number of plates washed clean with 5 liters of wash liquor (=plate count) is used as a measure of the cleaning effect.

Foaming Power 100 ml of cleaner solution in in-use concentrations (0.4 to 1.0 g/l; tapwater 16° d/45° C.) were shaken in a 250 ml mixing cylinder using a shaking machine of the kind made by Messrs. K. Hofmann, Berlin; using 20 revolutions of the cylinder at 55 r.p.m. The foam volume was read off with and without damping (addition of olive oil) by reading off the height of the foam of the foam from the calibration of the mixing cylinder.

Abrasive Effect

The abrasive effect of the preparation was determined using a combined carboxydrate/egg white/fat soil. To this end, 60 g "Milumil Babynahrung" (a baby food) were mixed with 80 g of water at 75° C. and the resulting mixture deaerated in a water jet vacuum. The mixture accumulating was applied in a layer thickness of 250 μm to VA steel plate over an area of 130 $cm^2$. It was then predried for 1 hour at 45° C. and then baked for 2 hours at 200° C. After cooling and weighing out, the soiled plates were scoured five times under constant pressure with 5 ml of the preparation using a soft needle felt pad (DLW type NV RC 800, diameter 48 mm). To this end, the fine steel plate was fixed to a table which was pressed by means of a hydraulic system against the pad rotated at 75 r.p.m. and at the same time moved back and forth (surrounding path=200 mm). The contact pressure and number of scouring movements were designed in such a way that a standard product according to EP No. 21,545, consisting of 24% by weight $C_{12}$–$C_{13}$ fatty alcohol (ethoxy)3-sulfate, 3.5% by weight $C_{12}$–$C_{14}$ alkyl dimethyl amine oxide, 6.5% by weight cristobalite (average particle diameter 40–50 μm), 0.5% by weight $Al_2O_3$, 4.0% by weight sulfosuccinic acid trisodium salt, 6.5% by weight ethanol, remainder water, dye and perfume, did not completely remove the soil. After the scoured plates had been rinsed with water, they were dried and reweighed. The abrasion corresponded to the abrasive effect and was expressed absolutely in mg or relatively in %, based on the appointed standard.

Surface Protection

In order to determine the mildness of the effect on sensitive surfaces, Plexiglass plates were treated by the method described above. The surfaces of the treated plates were measured using a Lange reflectometer (measuring head 60°). The results of the measurement were expressed in relation to the water value (corresponding to 100%).

Table 1 below shows the compositions of commercial cleaning preparations (A to E) for hard surfaces with-/without abrasives, and of preparation according to the invention.

Table 2 shows the results of the tests characterized above. The standard used was a product of 18% by weight of $C_{12}$–$C_{13}$ fatty alcohols ether sulfate, 4.0% by weight $C_{12}$–$C_{14}$ alkyl dimethyl amine oxide, 2% by weight sulfosuccinic acid trisodium salt, 7% by weight quartz powder (43–105 μm), 2.5% by weight Aerosil® 200 as suspension stabilizer; remainder water, dyes, electrolytes and perfumes corresponding to EP No. 21,545.

The results clearly show the advantages of the cleaning preparation produced in accordance with the invention over the standard product:

foaming power is not adversely affected by the abrasives, the scouring effect is surprisingly good despite the fineness of the abrasives, surprisingly, limonene as a fat solvent in quantities of only 0.2 to 0.8% by weight also increases the viscosity of the preparations of the invention, surface protection afforded by the cleaning preparations of the invention is surprisingly and significantly greater than that of the standard product.

TABLE 1

| | Composition of the Cleaning Preparations (% by weight) | | | | | | | | | | | | | | |
|---|---|---|---|---|---|---|---|---|---|---|---|---|---|---|---|
| RAW MATERIALS | A | B | C | D | E | 1 | 2 | 3 | 4 | 5 | 6 | 7 | 8 | 9 | 10 |
| $C_{12}$-alkylbenzene sulfonate, Na salt | 10 | 5 | 10 | — | — | 10 | 10 | 5 | 5 | 10 | 10 | — | — | — | — |
| $C_{12}$–$C_{16}$-sec. alkane sulfonate, Na salt | — | 5 | — | — | — | — | — | 5 | 5 | — | — | — | — | — | — |
| $C_{12}$–C_fatty alcohol sulfate, Na salt | — | — | 4 | — | — | — | — | — | — | 4 | 4 | — | — | — | — |
| $C_{12}$–$C_{14}$ fatty alcohol (ethoxy)$_2$-sulfate, Na salt | 10 | 10 | 6 | 18 | 18 | 10 | 10 | 10 | 10 | 6 | 6 | 18 | 18 | 18 | 18 |
| $C_{12}$–$C_{14}$-acyl-1,3-amidopropyl dimethyl aminoacetic acid betaine | — | — | — | 2 | 2 | — | — | — | — | — | — | 2 | 2 | 2 | 2 |
| $SiO_2$ (average particle diameter 6 μm) | — | — | — | — | — | 10 | — | — | 13 | — | — | — | 12 | — | — |
| $SiO_2$ (average particle diameter 10 μm) | — | — | — | — | — | — | 10 | 5 | — | — | 9 | — | — | — | 10 |
| $Al_2O_3$ (polishing alumina P 205, max. 5% > 44 μm | — | — | — | — | — | — | 2 | 7 | — | 4 | — | 10 | — | 6 | — |
| $Al_2O_3$ (polishing | — | — | — | — | — | — | — | — | — | — | — | — | — | 4 | — |

TABLE 1-continued

| Composition of the Cleaning Preparations (% by weight) | | | | | | | | | | | | | | | |
|---|---|---|---|---|---|---|---|---|---|---|---|---|---|---|---|
| alumina/CTS FG; max. 2% > 44 μm | | | | | | | | | | | | | | | |
| $Al_2O_3$ (polishing alumina PS, ultrafine, at least 99% < 20 μm | — | — | — | — | — | — | — | — | — | 9 | — | — | — | — | — |
| Sipernat TM 22S | — | — | — | — | — | — | — | 3.5 | 2 | — | — | 3.5 | 2 | — | — |
| Aerosil ® 200 | 3 | 3 | 3 | 3 | 3 | — | — | — | — | 1 | 0.5 | — | — | — | — |
| Kelzan ® M | — | — | — | — | — | — | — | — | — | — | — | — | — | 0.5 | 0.5 |
| Polyethylene glycol ∅ MW 600 | — | — | — | — | — | 0.5 | 0.5 | — | — | — | — | — | — | — | — |
| Polyethylene glycol ∅ MW 2 × $10^6$ (= POLYOX WR 205 ®) | | | | | | 0.5 | 0.5 | — | — | — | — | 0.05 | 0.05 | — | — |
| Limonene | — | — | — | — | 0.5 | — | — | — | — | — | — | — | — | 0.5 | 0.5 |
| Remainder | water, perfumes, electrolytes dyes, preservatives etc. | | | | | | | | | | | | | | |

| RAW MATERIALS | 11 | 12 | 13 | 14 | 15 | 16 | 17 | 18 | 19 | 20 | 21 | 22 | 23 | 24 | 25 |
|---|---|---|---|---|---|---|---|---|---|---|---|---|---|---|---|
| $C_{12}$-alkylbenzene sulfonate, Na salt | — | — | — | — | — | — | — | — | — | — | — | — | 10 | 17 | — |
| $C_{12}$–$C_{16}$-sec. alkane sulfonate, Na salt | — | — | — | — | — | — | — | — | — | — | — | — | — | — | 12 |
| $C_{12}$–$C_{14}$ fatty alcohol sulfate, Na salt | — | — | — | — | — | — | — | — | — | — | — | — | — | — | — |
| $C_{12}$–$C_{14}$ fatty alcohol (ethoxy)$_2$-sulfate, Na salt | 18 | 18 | 18 | 18 | 18 | 18 | 18 | 18 | 18 | 18 | 18 | 18 | 10 | 10 | 14 |
| $C_{12}$–$C_{14}$-acyl-1,3-amido-propyl dimethyl amino-acetic acid betaine | 2 | 2 | 2 | 2 | 2 | 2 | 2 | 2 | 2 | 2 | 2 | 2 | 3 | 3 | 4 |
| $SiO_2$ (average particle diameter 6 μm) | — | 10 | — | 10 | — | — | — | — | — | — | — | — | — | — | 13 |
| $SiO_2$ (average particle diameter 10 μm) | 10 | — | 10 | — | 10 | 10 | 10 | 10 | 10 | 10 | 10 | 10 | — | 10 | — |
| $Al_2O_3$ (polishing alumina P 205, max. 5% > 44 μm | 2 | — | 2 | — | 2 | — | 2 | — | 2 | — | 2 | — | 8 | — | — |
| $Al_2O_3$ (polishing alumina/CTS FG; max. 2% > 44 μm | — | — | — | — | — | — | — | — | — | — | — | — | 2 | 2 | — |
| $Al_2O_3$ (polishing alumina PS, ultrafine, at least 99% < 20 μm | — | — | — | — | — | — | — | — | — | — | — | — | — | — | — |
| Sipernat TM 22S | — | — | — | — | — | — | — | — | — | — | — | — | 3 | 2 | — |
| Aerosil ® 200 | 3 | 2 | 3 | 2 | 2 | 1 | 2 | 1 | 2 | 1 | 2 | 1 | — | — | — |
| Kelzan ® M | — | — | — | — | — | — | — | — | — | — | — | — | — | — | — |
| Polyethylene glycol ∅ MW 600 | 1 | 1 | 1 | 1 | — | — | — | — | — | — | — | — | 0.5 | 6 | 3 |
| Polyethylene glycol ∅ MW 2 × $10^6$ (= POLYOX WR 205 ®) | — | — | — | — | — | — | — | — | — | — | — | — | — | — | — |
| Limonene | — | — | 0.5 | 0.5 | — | — | 0.5 | 0.5 | 1 | 1 | 1.5 | 1.5 | — | — | 0.5 |
| Remainder | water, perfumes, electrolytes dyes, preservatives etc. | | | | | | | | | | | | | | |

TABLE 2

TEST RESULTS

| METHOD | A | B | C | D | E | 1 | 2 | 3 | 4 | 5 | 6 | 7 | 8 | 9 | 10 | 11 |
|---|---|---|---|---|---|---|---|---|---|---|---|---|---|---|---|---|
| Viscosity (mPas)* | 2800 | 2400 | 2700 | 3000 | 2800 | 3800 | 3800 | 3900 | 3900 | 4900 | 4100 | 4500 | 4500 | 4900 | 4900 | 4400 |
| | 3400 | 3000 | 3400 | 3800 | 3100 | 4800 | 4800 | 4700 | 4700 | 5700 | 4900 | 5200 | 5200 | 5600 | 5600 | 5200 |
| Plate test (plate count) | | | | | | | | | | | | | | | | |
| Beef tallow | 14 | 13 | 13 | 15 | 15 | 14 | 14 | 13 | 13 | 13 | 13 | 15 | 15 | 14 | 14 | 14 |
| Mixed soil | 17 | 16 | 17 | 29 | 28 | 28 | 28 | 16 | 16 | 17 | 17 | 29 | 29 | 28 | 28 | 29 |
| Foam volume (ml, after 1 minute, 1 g/l | | | | | | | | | | | | | | | | |
| 0 ml | 115 | 110 | 100 | 105 | 110 | 115 | 115 | 115 | 115 | 100 | 100 | 110 | 110 | 115 | 115 | 110 |
| OLIVE OIL | | | | | | | | | | | | | | | | |
| 10 ml | 80 | 75 | 60 | 65 | 65 | 80 | 80 | 80 | 80 | 65 | 65 | 80 | 80 | 85 | 85 | 80 |
| Abrasive effect (% of standard) | — | — | — | — | — | 60 | 80 | 95 | 65 | 85 | 55 | 110 | 60 | 105 | 60 | 80 |
| Surface protection (% of water value = 100) | 100 | 100 | 100 | 100 | 100 | 95 | — | — | 100 | — | 90 | — | 95 | — | 100 | — |

| METHOD | 12 | 13 | 14 | 15 | 16 | 17 | 18 | 19 | 20 | 21 | 22 | 23 | 24 | 25 | Standard |
|---|---|---|---|---|---|---|---|---|---|---|---|---|---|---|---|
| Viscosity (mPas)* | 4400 | 4900 | 4900 | 4100 | 4100 | 4700 | 4700 | 3600 | 3600 | 2400 | 2400 | 5100 | 4500 | 2300 | 4000 |
| | 5200 | 5700 | 5700 | 4500 | 4500 | 5400 | 5400 | 4000 | 4000 | 2800 | 2800 | 6000 | 6000 | 3000 | 4500 |
| Plate test (plate count) | | | | | | | | | | | | | | | |
| Beef tallow | 14 | 15 | 15 | 14 | 14 | 15 | 15 | 14 | 14 | 14 | 14 | 15 | 19 | 18 | 15 |
| Mixed soil | 29 | 29 | 29 | 28 | 28 | 28 | 28 | 29 | 29 | 27 | 27 | 24 | 34 | 36 | 29 |

TABLE 2-continued

| TEST RESULTS | | | | | | | | | | | | | | | |
|---|---|---|---|---|---|---|---|---|---|---|---|---|---|---|---|
| Foam volume (ml, after 1 minute, 1 g/l | | | | | | | | | | | | | | | |
| 0 ml | 110 | 110 | 110 | 115 | 115 | 110 | 110 | 115 | 115 | 110 | 110 | 115 | 200 | 180 | 120 |
| OLIVE OIL | | | | | | | | | | | | | | | |
| 10 ml | 80 | 75 | 75 | 80 | 80 | 75 | 75 | 80 | 80 | 70 | 70 | 80 | 100 | 110 | 85 |
| Abrasive effect (% of standard) | 55 | 85 | 60 | 80 | 55 | 80 | 60 | 85 | 55 | 80 | 60 | 105 | 85 | 60 | 100 |
| Surface protection (% of water value = 100) | 100 | — | 100 | — | 95 | — | 95 | — | 100 | — | 100 | — | — | 100 | 35 |

*Viscosity values were determined using a Contraves Rheomat 115 at $D = 5\ s^{-1}$ (D = shear gradient)

In addition to their suitability for washing and cleaning soiled hard surfaces, the preparations produced in accordance with the invention—where they contain ultrafine abrasives/polishes, such as Sident ®—are also suitable for reviving tarnished metal surfaces (cutlery, jewelry etc.) and for cleaning plastic surfaces. In this case, surface preservation is comparable with that achieved where only water is used, i.e. the preparations produced in accordance with the invention do not leave any scratches visible to the eye.

Taking the cleaning of silver as an example, the effect of the preparation according to the invention was compared with that of a commercial silver cleaner (Puragan TM, base thiourea).

The pieces of silver were cleaned by hand using a soft cloth and then rinsed with water. After drying, they were visually assessed by five people. The marking system is defined in Table 3 below.

TABLE 3

| Preparation | Cleaning | Preserving effect |
|---|---|---|
| Puragan | 1 | 2 |
| Example 2 | 1 | 1 |
| Marking system | 4 = no removal of tarnish<br>1 = clean | 1 = no visible scratches<br>4 = badly scratched |

What is claimed is:

1. A builder-free aqueous, liquid, suspension-stable multipurpose cleaning composition consisting essentially of:

A. from about 10 to about 35% by weight, based on the weight of the cleaning composition, of a mixture of at least two of the following:
(a) at least one anionic sulfonate surfactant,
(b) at least one anionic sulfate surfactant, and
(c) at least one amphoteric surfactant, wherein when the mixture consists of a mixture of (a) and (b), from about 5 to about 95% by weight of (a) and correspondingly from about 95 to about 5% by weight of (b) is present, based on the weight of the mixture, and when the mixture consists of (c) and either one or both of (a) and (b), then (c) is present in from about 0.5 to about 15% by weight, based on the weight of the cleaning composition, provided that when (c) is present the ratio by weight of (a) or (b) or (a)+(b) to (c) is from about 20:1 to about 1:1;

B. from about 5 to about 20% by weight, based on the weight of the cleaning composition, of at least one abrasive having a particle diameter of from about 5 to about 15 μm;

C. at least one viscosity regulator in amount sufficient to regulate the viscosity of the cleaning composition to from about 4,000 to about 6,000 mPas;

D. from 0.3 to about 1% by weight based on the weight of the cleaning composition, of fat solvent selected from a terpene hydrocarbon, a terpene alcohol, and a glycol ether having a molecular weight of greater than about 200,000 to about 4,000,000;

E. a pH regulator in amount sufficient to provide a pH in the range of from about 5.5 to about 9.5 for the cleaning composition; and F. the remainder, water.

2. A cleaning composition according to claim 1 wherein from about 15 to about 25% by weight of component A. is present.

3. A cleaning composition according to claim 1 wherein when component A. consists of a mixture of (a) and (b), then from about 25 to about 75% by weight of (a) and correspondingly from about 75 to about 25% of (b) is present in the mixture.

4. A cleaning composition according to claim 1 wherein in component A. (c) is present in from about 0.5 to about 5% by weight based on the weight of the cleaning composition.

5. A cleaning composition according to claim 4 wherein (c) is present in from about 1 to about 2 weight percent.

6. A cleaning composition according to claim 1 wherein in component A. the ratio by weight of (a) or (b) or (a)+(b) to (c) is from about 15:1 to about 1:1.

7. A cleaning composition according to claim 6 wherein said ratio is from about 8:1 to about 1:1.

8. A cleaning composition according to claim 1 wherein component B. is present in from about 10 to about 15% by weight based on the weight of the cleaning composition.

9. A cleaning composition according to claim 1 wherein component C. is present in from about 2 to about 6% by weight based on the weight of the cleaning composition.

10. A cleaning composition according to claim 1 wherein component E. is present in amount sufficient to provide a pH in the range of from about 6.0 to about 7.5.

11. A cleaning composition according to claim 1 wherein component B. is selected from the group consisting of silicon dioxide and aluminum oxide.

12. A cleaning composition of claim 1 in diluted form in water wherein at least about 0.25 grams of the cleaning composition of claim 1 are present in each liter of solution.

13. A cleaning composition according to claim 12 wherein from about 0.4 to about 1.0 grams of the cleaning composition of claim 1 per liter of solution are present therein.

14. A method of cleaning a hard surface comprising contacting said surface with a cleaning-effective quantity of the cleaning composition of claim 1.

15. A method of cleaning a hard surface comprising contacting said surface with a cleaning-effective quantity of the cleaning composition of claim 12.

* * * * *